United States Patent [19]

van Bogaert

[11] Patent Number: 4,564,053

[45] Date of Patent: Jan. 14, 1986

[54] WEFT GRIPPER DRIVE FOR LOOMS

[75] Inventor: Philippe van Bogaert, Brussel, Belgium

[73] Assignee: N.V. Weefautomaten Picanol, Ieper, Belgium

[21] Appl. No.: 591,986

[22] Filed: Mar. 21, 1984

[30] Foreign Application Priority Data

May 18, 1983 [BE] Belgium ..... 2/60094

[51] Int. Cl.[4] ..... D03D 47/00

[52] U.S. Cl. ..... 139/449

[58] Field of Search ..... 139/443, 444, 445, 446, 139/447, 449

[56] References Cited

U.S. PATENT DOCUMENTS

| | | | |
|---|---|---|---|
| 733,586 | 7/1903 | Hutchins | 139/449 |
| 2,604,123 | 7/1952 | Budzyna et al. . | |
| 2,810,403 | 10/1957 | Sanderson et al. . | |
| 2,888,956 | 6/1959 | Flamand et al. . | |
| 3,490,498 | 1/1970 | Dewas . | |
| 3,884,275 | 5/1975 | Camprubi | 139/449 |

FOREIGN PATENT DOCUMENTS

| | | |
|---|---|---|
| 65231 | 11/1982 | European Pat. Off. . |
| 202765 | 9/1908 | Fed. Rep. of Germany . |
| 1277766 | 9/1968 | Fed. Rep. of Germany . |
| 2217541 | 9/1974 | France . |
| 7714245 | 6/1978 | Netherlands . |
| 585293 | 2/1977 | Switzerland . |
| 342253 | 1/1931 | United Kingdom . |
| 424966 | 2/1935 | United Kingdom . |
| 1510791 | 4/1975 | United Kingdom . |
| 1396492 | 6/1975 | United Kingdom . |
| 1510792 | 5/1978 | United Kingdom . |

*Primary Examiner*—Henry S. Jaudon

*Attorney, Agent, or Firm*—Schwartz, Jeffery, Schwaab, Mack, Blumenthal & Evans

[57] ABSTRACT

Weft gripper drive for looms of the type consisting of a flexible perforated tape at one end of which a gripper is fixed and of an oscillating gear-wheel that enmeshes with the tape along part of its circumference, whereby guiding devices are provided where the tape leaves the wheel, characterized thereby that the tooth height of the wheel is smaller than the thickness of the tape and that the form and dimensions of the teeth and of the perforations barely allow a mutual enmeshment, whereby the side of the tape directed towards the wheel, in the enmeshment zone, is tangent to the root circle of the gearing of the wheel.

8 Claims, 4 Drawing Figures

WEFT GRIPPER DRIVE FOR LOOMS

BACKGROUND OF THE INVENTION

1. Field of the Invention

This invention relates to a weft gripper drive for looms, the weft which is being pulled through the shed by at least one grab that is fixed to an end of a flexible belt, that is driven to and fro by an oscillating wheel.

2. Prior Art

The known weft gripper drives with flexible lance or tape can be subdivided into two large groups, depending on whether the lance is driven by a toothless driving wheel or by a gearwheel. This invention makes part of the second group.

Both groups have in common, among other things, the problem to realize an efficient contact between tape and wheel—with a minimum wear and heating—in order to realize a sufficiently precise movement of the gripper.

In the first group, steel tapes are being used that are driven by heavy toothles drive wheels. In order to keep and conduct the solid steel tape around and in constant contact with the rather intricate wheel, all sorts of complicated devices have been tried, such as hold-down rollers and anti-friction rollers (GB No. 342.253; 424.966; U.S. Pat. No. 2,604,123; FR No. 2.217.541), magnets (U.S. Pat. No. 2,810,403), arched shoe-blocks (U.S. Pat. No. 2,888,956), pneumatic systems (U.S. Pat. No. 1,277,766) etc. Such devices require the use of lubricants and coolants in order to reduce wear and heating, with all the drawbacks involved.

In the second group, plastic perforated tapes and gear-wheels are being used, that emmesh into each other. Concerning the guiding of the tape around part of the circumference of a gear-wheel, different systems are being proposed:

anti-friction rollers (CH No. 585.293);

cylindrical self-lubricating segments, for example made of graphite (U.S. Pat. No. 3,490,498);

guiding of a double lance along ±180° of the circumference of the wheel by means of the guiding device in both zones where the tape leaves the wheel (DE No. 2.02.765);

special wheel that enmeshes with the tape along 50°–180° (GB Nos. 1.510.791, 1.510.792).

two pairs of hold-down rollers that enmesh with the tape at both sides of the perforations (NL No. 77.14.245);

horizontal wheel and three hold-down rollers (GB No. 1.396.492);

long curved brake-like shoes (EP No. 65.231).

It became apparent that none of the known devices could operate in a really satisfactory manner, especially at the high weaving speeds required at present.

Heating and wear problems are always present, so that tapes have to be replaced relatively soon, which will prejudice productivity.

OBJECTS AND SUMMARY OF THE INVENTION

The object of the invention is to provide for a weft gripper drive that completely eliminates above-mentioned problems.

Therefore, a weft gripper drive is introduced, characterized thereby that the tooth height of the wheel is smaller than the thickness of the tape and that the form and dimensions of the teeth and of the perforations hereby allow a mutual enmeshing, whereby the side of the tape directed towards the wheel, in the enmeshing zone, is tangent to the root circle of the gearing of the wheel;

BRIEF DESCRIPTION OF THE DRAWINGS

In order to illustrate the features and properties of the invention better, they are further described with references to the accompanying schematic drawings, wherein.

DETAILED DESCRIPTION OF THE INVENTION

Figure 1:
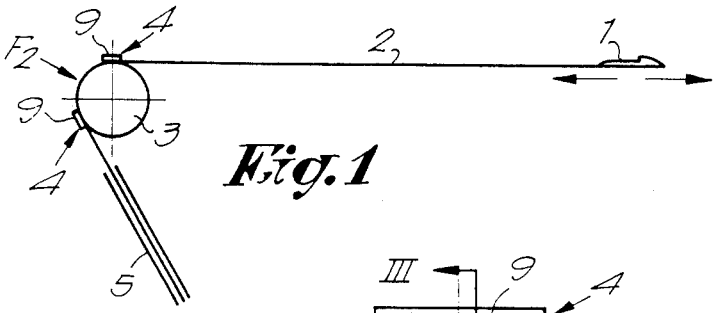
FIG. 1 shows the considered parts of a weft gripper drive wherein the invention is being applied.
Figure 2:
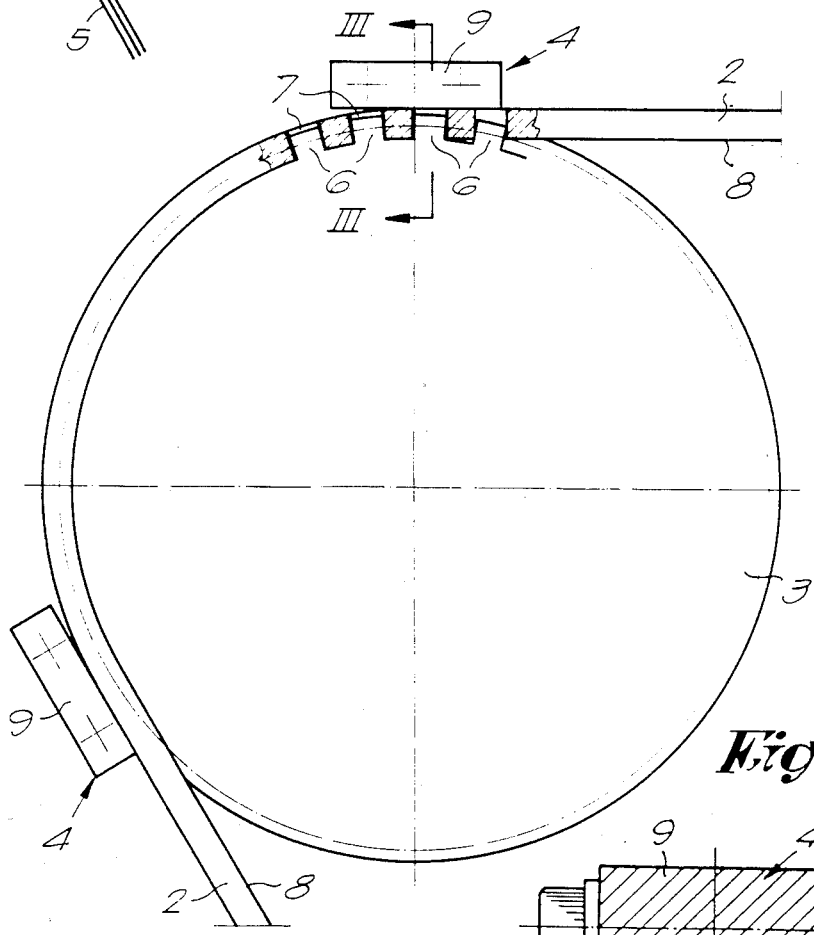
FIG. 2, on a greater scale and partly cut away, shows the part indicated by arrow F2 in FIG. 1.
Figure 3:
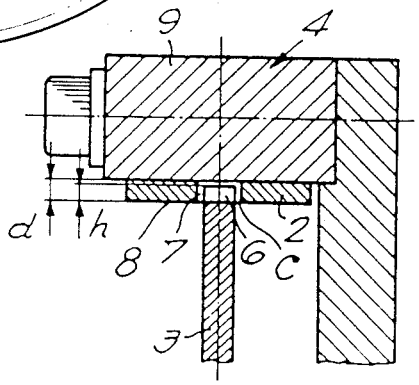
FIG. 3 shows a section along line III—III of FIG. 2.
Figure 4:
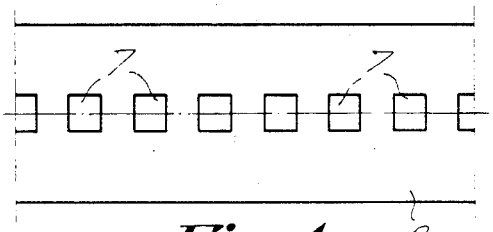
FIG. 4 shows a part of the flexible tape from above.

A weft gripper 1 is fixed to the end of a flexible perforated tape 2, that is being driven to and fro by an oscillating wheel 3, with which two guiding devices 4 cooperate to guide the tape 2 along part of the wheel 3. The other end of tape 2 is guided into a sleeve 5 or the like. Such an arrangement is generally known.

According to the invention, the height h of each tooth 6 of the wheel 3 is smaller than the thickness d of the tape 2, the other dimensions and form of the teeth 6 and the perforations of the tape 2 being chosen in such a way that they barely allow the enmeshment, but also that during the enmeshment the side 8 of the tape 2 directed towards the wheel is tangent to the root circle C of the gearing of the wheel 3.

The guiding devices 4 each consists of two blocks 9 made of hard and highly heat conducting material, for example hard steel. The width of each block 9 is substantially equal to that of tape 2.

The blocks 9 are fixed to the frame of the loom in such a way that they are provided along the circumference of the wheel 3. The blocks 9 guide the tape 2 in order to obtain permanent contact between the tape 2 and the wheel 3, especially between side 8 of tape 2 and the surfaces formed by the root circle C of the gearing of the wheel 3.

The advantages of the measures described hereinabove are substantially the following.

Because of the small radial size of the enmeshing surfaces and because of the fact that the side 8 of tape 2 is tangent to the root circle C of the gearing of the wheel 3, the mutual friction between these surfaces and therefore also wear is only slight.

Because of the precise enmeshment between wheel 3 and belt 2, this belt requires no extra lateral guiding; furthermore the driving forces are equally divided over the working teeth 6. One of the results thereof is that the dimensions of the teeth 6 and perforations 7 can be relatively small, in favour of the resistance of tape 2.

The blocks 9 do not have to exercise a pressure worth mentioning on the tape 2, thanks to the exact enmeshment and the fact that they can operate over the total width of the tape 2.

I claim:

1. A weft gripper drive for looms of the type comprising a flexible perforated tape at one end of which a gripper is fixed and an oscillating gear-wheel that enmeshes with the said tape along an arc of its circumference, whereby guiding devices are provided at the points where the tape leaves the wheel, characterized thereby that the tooth height of the wheel is smaller than the thickness of the tape and that the form and dimensions of the teeth and of the perforations barely allow a mutual enmeshment, whereby the side of the tape directed towards the wheel, in the enmeshment zone, is tangent to the root circle of the gearing of the wheel.

2. The weft gripper drive according to claim 1, characterized thereby that the guiding devices each comprises a block of hard and highly heat-conducting material.

3. The weft gripper drive according to claim 2, characterized thereby that said guiding blocks have a width that is substantially equal to the width of the tape.

4. A weft gripper drive for looms of the type comprising a flexible perforated tape at one end of which a gripper is fixed and an oscillating gear-wheel that enmeshes with the said tape along part of its circumference, whereby guiding devices are provided where the tape leaves the wheel, characterized thereby that the tooth height of the wheel is smaller than the thickness of the tape and that the form and dimensions of the teeth and of the perforations barely allow a mutual enmeshment, whereby the side of the tape directed towards the wheel, in the enmeshment zone, is tangent to the root circle of the gearing of the wheel; and therein the guiding devices each comprises a block of hard and highly heat-conducting material.

5. The weft gripper drive according to claim 4, characterized thereby that said guiding blocks have a width that is substantially equal to the width of the tape.

6. A weft gripper device for looms comprising:

(a) a flexible perforated tape of a predetermined thickness and having a gripper at one end thereof, (b) an oscillating gear-wheel enmeshing said tape along the circumference of the gear-wheel, (c) a guiding means adjacent at two points on the circumference generally where the tape leaves the gear-wheel, said guiding means including a plurality of teeth on the gear-wheel, said teeth having a height which is less than the predetermined thickness of the tape; the dimensions of said teeth substantially filling the perforations thereby barely allowing mutual enmeshment, whereby the side of the tape adjacent the wheel in the zone of enmeshment being tangent to the root circle of the gearing of the wheel.

7. The weft guiding device according to claim 6 wherein said guiding means is formed of highly heat-conducting material.

8. The weft guiding device according to claim 7 wherein the width of said block and said tape are substantially equal.

* * * * *